US006364636B1

(12) United States Patent
Chang

(10) Patent No.: US 6,364,636 B1
(45) Date of Patent: Apr. 2, 2002

(54) STRUCTURE OF A MINIATURE PUMPING MACHINERY

(76) Inventor: Kun-Lin Chang, 3F, No. 22, Ho-Ping Rd., Pan-Chiao City, Taipei Hsien (TW)

( * ) Notice: Subject to any disclaimer, the term of this patent is extended or adjusted under 35 U.S.C. 154(b) by 0 days.

(21) Appl. No.: 09/515,208

(22) Filed: Feb. 29, 2000

(51) Int. Cl.[7] ..... F04B 17/00; F04B 49/00; F04B 41/06; F04B 45/00

(52) U.S. Cl. ..... 417/413.1; 417/47; 417/412; 417/533

(58) Field of Search ..... 417/413.1, 473, 417/533, 412

(56) References Cited

U.S. PATENT DOCUMENTS 4,507,058 A * 3/1985 Schoenmeyr ..... 417/270
4,801,249 A * 1/1989 Kakizawa ..... 417/269
5,178,515 A * 1/1993 Tsuchiya et al. ..... 415/206
5,332,370 A * 7/1994 Nakayama et al. ..... 417/413 R
5,588,811 A * 12/1996 Price ..... 417/350

* cited by examiner

*Primary Examiner*—Charles G. Freay
*Assistant Examiner*—Timothy P. Solak
(74) *Attorney, Agent, or Firm*—Rosenberg, Klein & Lee

(57) ABSTRACT

A miniature diaphragm pump includes a motor unit, a compression portion, and an air collection portion. The output air is injected into the inner space of the pump through the air inlet formed at the motor unit, and the air exits from the pump through an air output port provided at the air collecting portion. A pair of air bags are provided at the compression portion which are compressed by the ends of a cross-bar in alternating fashion and a system of check valves is arranged in such a manner that to prohibit a back flow of air. A follower rod extending from the cross bar is inserted into an eccentric hole formed on a rotation member in the motor unit to make eccentric circular motion when the motor rotates in order to compress one of the air bags at a time in order to send air to the air output port of the air collection portion of the pump.

4 Claims, 5 Drawing Sheets

STRUCTURE OF A MINIATURE PUMPING MACHINERY

BACKGROUND OF THE INVENTION

1. Field of the invention

The present invention relates to structure of a miniature pumping machinery, and more particularly, to a miniature diaphragm pump in which an air flow route is appropriately governed to stabilize the air flow rate.

2. Description of the prior art

A general function of a conventional miniature pumping machinery is either simply outputting compressed air, or repeatedly performing the action of inhaling/exhausting air at a stationary position. An ordinary check valve is required for maintaining a desirous pumping function. Defects in structural design of the pump may cause interrupted flow of air therein.

For example, a widely used electric sphygmomanometer operated according to the principle of miniature pumping machinery based on prior art needs a check valve to be installed outside of the pump so as to prevent high pressure air from flowing back into the pump thereby causing an erroneous measurement.

In order to eliminate the imperfectness inherent to the conventional technique as mentioned above, the present inventor has designed a miniature diaphragm pump of the present invention.

SUMMARY OF THE INVENTION

It is an object of the present invention to provide a miniature diaphragm pump which can guide the air to flow smoothly so as to stabilize the air output.

It is another object of the present invention to provide a miniature diaphragm pump which can eject the air through an output port uniformly and prevent the air from flowing back into the pump via flow passage.

It is still another object of the present invention to provide a miniature diaphragm pump which can operate quietly with an energy saving effect.

To achieve these and other objects, the present invention provides a miniature diaphragm comprising a motor unit, a compression portion, and an air collecting portion. The output air is ejected through an air output port provided at the air collecting portion, while an air inlet is provided at the base of the motor unit so that air inlet and air outlet are separately provided in different portions of the pump. A pair of check valves are installed at the compression portion and at the air collection portion, so that the air may flow smoothly with stabilized air amount, wherein back flow of air is prevented. A follower rod conjoined with a cross bar provided in the compression portion is inserted in an eccentric hole formed on a rotation member in the motor unit to make eccentric circular motion when the motor unit is rotated in order to compress a pair of air bags in the compression portion in alternating fashion with the cross bar to send air to the air collection portion for a quiet and energy saving operation of the pump.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE PREFERRED EMBODIMENT

Figure 1:
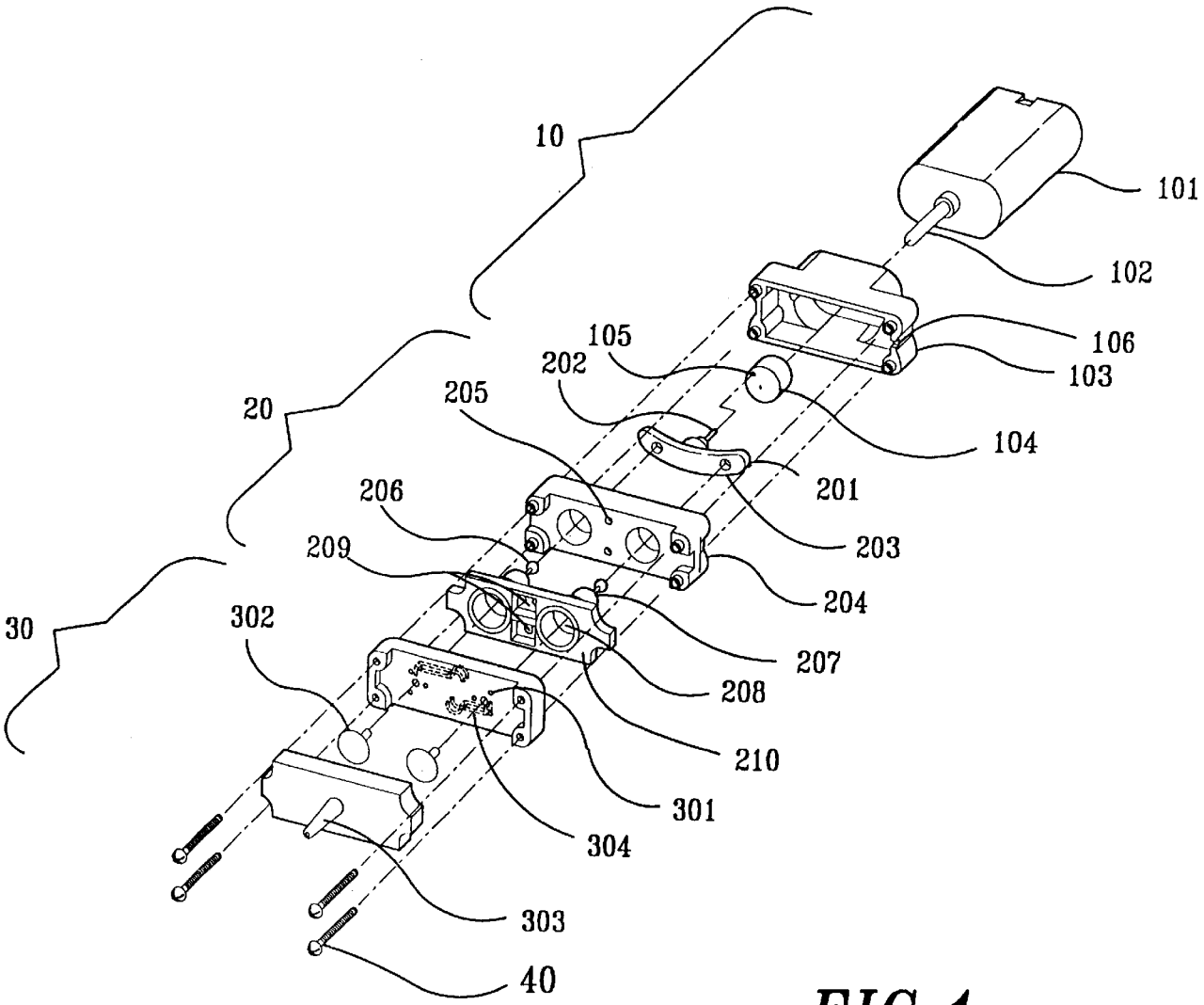
FIG. 1 is an exploded three dimensional view of structure for a miniature diaphragm pump according to the present invention.

Referring to FIG. 1, a miniature diaphragm pump of the present invention comprises a motor unit 10, a compression portion 20, and an air collection portion 30. The three portions are conjoined together with a plurality of locking elements 40 such as screws.

The motor unit 10 includes a motor 101, a base 103, and a rotation member 104 with an eccentric hole 105. A protruded shaft 102 extends from the motor 101 through the base 103 to be coupled with the rotation member 104. An air inlet 106 is formed on the base 103 at the side of the rotation member 104.

The compression portion 20 includes a cross bar 201, a fixing member 204, and a common leak proof washer 210 having a pair of compression chambers 208. A follower rod 202 extends from the cross bar 201 to be engaged with the eccentric hole 105 formed at the rotation member 104. The follower rod 202 is adapted to be inclined with respect to the cross bar 201 and the rotation member 104. Each compression chamber 208 includes an air bag 207. Each air bag 207 is engaged with a slot mortise 203 provided on the cross bar 201 with a tenon 206 extending through the fixing member 204. An upper and lower first check valves are provided in the compression portion 20. Each upper and lower check valve includes a check valve aperture 205 formed in the fixing member 204 aligned with respective check stoppers 209 formed at the common leak proof washer 210 between the compression chambers 208.

The air collection portion 30 includes a pair of air guide slots 304 concavely formed on an enclosure (air guiding member) for fluid communication between the valves (205 and 209) and the air bags 207, flow passages 301 aligned with corresponding air bags 207, a pair of membrane washers 302 covering the flow passages 301 from outside and serving as a pair of second check valves, and an end member having an air output port 303 formed therein and extending outwardly for outputting the air.

Figure 2:
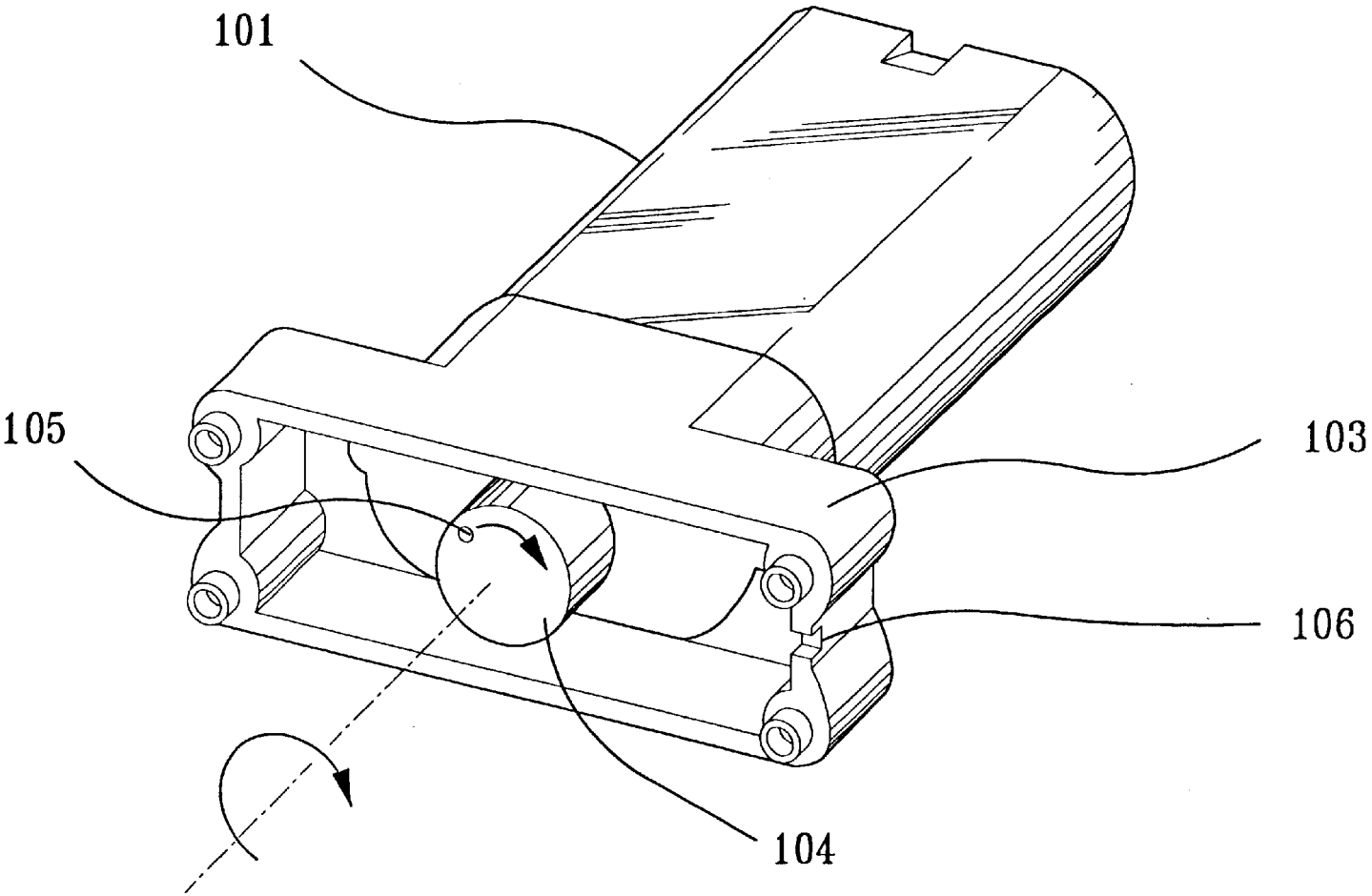
FIG. 2 is an assembled schematic view of the motor unit of the pump of the present invention.

Referring to FIG. 2, all the component parts and their relation have already been described above and will not be repeated. It is therefore easy to be understood that the follower rod 202 which is inserted into the eccentric hole 105 will be actuated to move as the motor unit 10 is energized to rapidly rotate the rotation member 104 placed to the shaft 102 of the motor 101.

Figure 3:
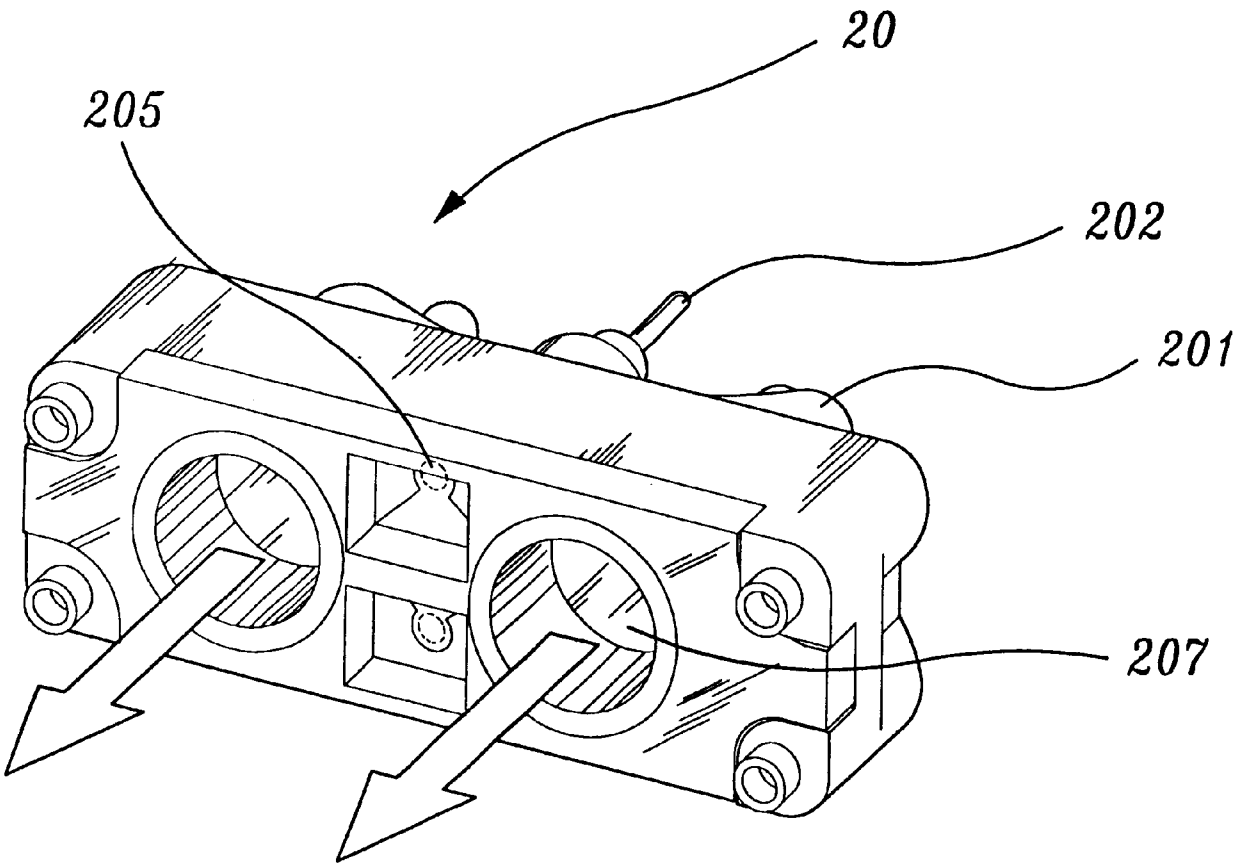
FIG. 3 is an assembled schematic view of the compression portion of the pump of the present invention.

As shown in FIG. 3, after the compression portion 20 is assembled, by inserting the follower rod 202 into the eccentric hole 105 shown in FIG. 2, eccentric rotation of the follower rod 202 force the cross bar 201 to oscillate and to compress the air bags 207 in alternating fashion, thereby either filling the air bags with air or sending the air to the air collection portion 3 for exiting through the air output port 303, as will be described in detail in further paragraphs.

Figure 4:
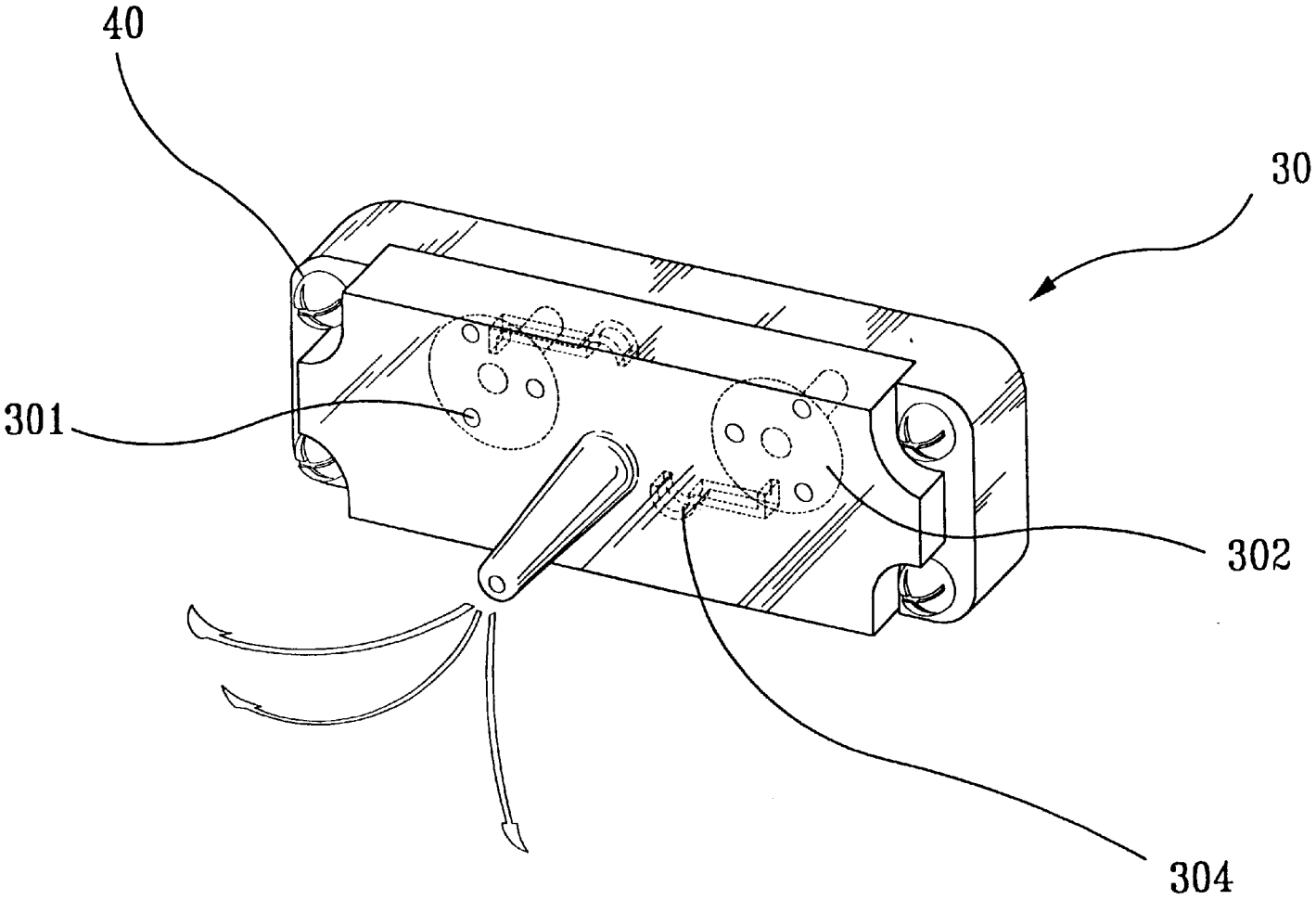
FIG. 4 is an assembled schematic view of the air collection portion of the pump of the present invention.

Referring to FIGS. 3 and 4 simultaneously, upon actuation of the motor 101, the rotation member 104 performs rotational movement, thus causing (through the eccentric motion of the follower rod 202) engagement of the ends of cross-bar 201 with one of the air bags 207 in alternating fashion, thus changing the state of the air bags 207 between the inflation (filled with the air) state and compressed state thereof.

When one of the air bags 207 is in the inflation states thereof, the corresponding first check valve (for example, the lower one) consisting of the aperture 205 and the check stopper 209, is opened due to the inner space pressure of the air entering into the space between the base 103 and the fixing member 204 through the air inlet 106. Therefore, the air passes through the lower check valve (205, 209) and fills the corresponding air bag via the air guide slot 304 extending therebetween. In the same time, the membrane washers 302 serving as the second check valves are tightly closed by internal air pressure. At the moments, when the cross-bar 201 compresses said one of the air bags 207, the lower check valve (205 and 209) is closed tightly by the inner air pressure, and the air filling the air bag 207 exits therefrom and opens the corresponding second check valve (by detaching the membrane washer 302 from the air guiding member) due to pressing action of the air from the compressed air bag 207 through the opening of the second check valve formed in the air guiding member. When the membrane washer 302 is detached from its opening, the flow passages 301 are open, and the air flow from the air bag 207 is allowed to the air output 303 to exit therethrough from the pump. As the air bags 207 are compressed in a predetermined fashion, the air introduced into the air collection portion 30 via the air passages 301 may be uniformly ejected out of the air output pore 303. Moreover, a back flow of air through the air passages 301 can be effectively prevented by the membrane washers 302.

Figure 5:
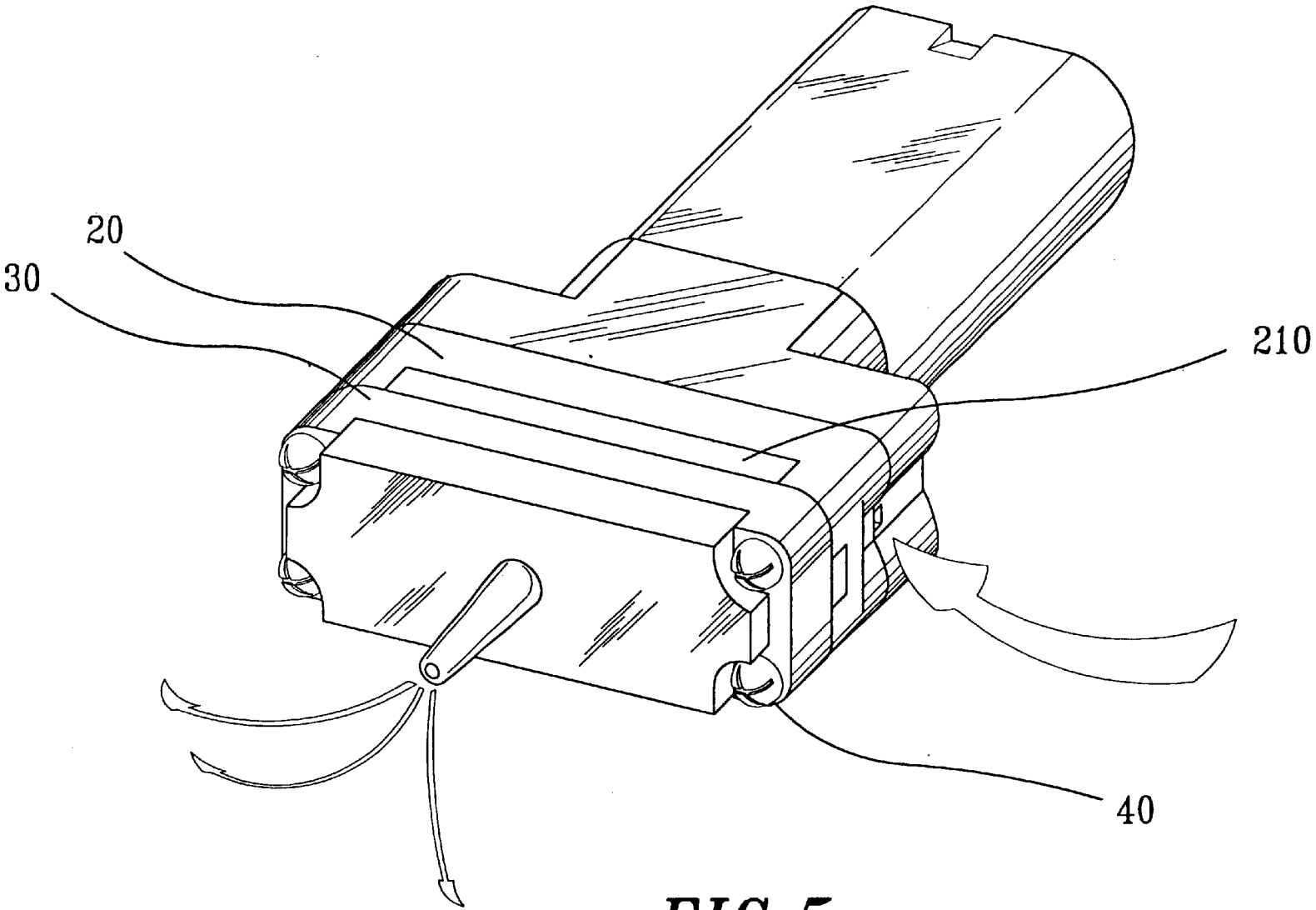
FIG. 5 is a perspective view of the assembled pump of the present invention.

Referring to FIG. 5, the entire unit of the pump of the present invention is assembled by a plurality of locking elements 40 such as screws with a leak proof gasket 210 sandwiched between the compression portion 20 and the air collection portion 30 in order to maintain a predetermined pressure in the inner space of the pump and to stabilize the amount of output air.

From the above detailed description, it can be clearly understood by those skilled in the art that the objects of the present invention to provide a miniature diaphragm pump which can guide the air smoothly with a stable amount of air output, eject the air uniformly through an output port without back flow of air, and operate quietly with energy saving effect has been achieved in the present invention.

Many changes and modifications in the above described embodiment of the present invention can be carried out without departing from the scope thereof. To promote the progress in science and the useful arts, the invention is disclosed and is intended to be limited only by the scope of the appended claims.

What is claimed is:

1. A miniature diaphragm pump, comprising:

a motor unit, an air collection portion and a compression portion sandwiched between said motor unit and said air collection portion;

said motor unit including:

a motor having a shaft axially extending from said motor, a base attached to said motor with said shaft extending therethrough, said base having an air inlet formed therein, and a rotation member having an eccentric hole formed therein, said rotation member being attached to said shaft for performing rotational movement therewith once said motor is actuated;

said compression portion including:

an elongated cross-bar having a pair of opposite ends with a slot mortize defined at each said opposite end, said cross-bar including a follower rod extending therefrom towards said rotation member and engaged into said eccentric hole formed thereat, an upper and a lower check valve means, each including a check valve aperture and a check valve stopper, a fixing member secured to said base, said cross-bar coupled to said rotation member being sandwiched therebetween, said fixing member including a pair of through openings and an upper and a lower said check valve apertures formed between said through openings, a common leak proof washer positioned in close proximity to said fixing member and having a pair of compression chambers aligned with said through openings of said fixing member, said common leak proof washer including a first and a second air bags extending from said compression chambers through said through openings of said fixing member, said common leak proof washer further including an upper and lower said check valve stoppers aligned with said upper and lower check valve apertures formed at said fixing member, each said air bag having a tenon attached thereto and engaging a respective one of said slot mortizes formed in said elongated cross-bar, said first and second air bags assuming, in an alternating fashion, an inflation state and a compressed state thereof;

said air collection portion including:

an air guiding member attached to said fixing member, said common leak proof washer being sandwiched therebetween, said air guiding member including:

a first and a second pluralities of flow passages crossing said air guiding member at first and second areas thereof aligned with said compression chambers formed in said common leak proof washer, first and second membrane washers removably attached to said first and second areas of said air guiding member, a first and second air guide slots formed in said air guiding member, said first air guide slot extending between said first area of said air guiding member and an area thereof aligned with said lower check valve means, and said second air guide slot extending between said second area of said air guiding member and an area thereof aligned with said upper check valve means; and an end member secured to said air guiding member and having an air outlet port formed therein;

wherein, upon actuation of said motor, said rotation member performs rotational movement for generating upward-downward movement of said opposite ends of said cross-bar with respect to said fixing member, thus causing engagement of said cross-bar with one of said first and second air bags in alternating fashion for changing the state of said first and second air bags between said inflation and compressed states thereof, wherein, when said first air bag is in said inflation state thereof, said lower check valve means is opened, said first membrane washer is attached to said first area of said air guiding member; thus closing said first plurality of the flow passages formed therethrough, and the air flow entering through said air inlet formed at said base into a space defined between said base and said fixing member, passes through said lower check valve means from said space via said first air guide slot to fill said first air bag, and wherein, when said first air bag is in said compressed state thereof, said lower check valve means is closed, and the air filing said first air bag exits therefrom and causes detachment of said first membrane washer from said area of said air guiding member, thus opening said first plurality of the flow passages formed therethrough, and thus allowing the air flow from said first air bag through said first plurality of the flow passages to said air outlet port for exiting therethrough.

2. The miniature diaphragm pump of claim 1, wherein said motor unit, said compression portion, and said air collection portion are secured each to the other by means of a plurality of locking elements.

3. The miniature diaphragm pump of claim 1, further comprising a leak proof gasket sandwiched between said compression portion and said air collection portion to maintain a predetermined pressure of the air in an inner space of said pump.

4. The miniature diaphragm pump of claim 1, wherein said first and second check valve means are alternatively opened by a pressure of the air contained in an inner space defined in said pump.

* * * * *